US006497582B1

(12) United States Patent
Hoffmeyer

(10) Patent No.: US 6,497,582 B1
(45) Date of Patent: Dec. 24, 2002

(54) LGA CONNECTOR WITH INTEGRATED GASKET

(75) Inventor: Mark Kenneth Hoffmeyer, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/934,763

(22) Filed: Aug. 22, 2001

(51) Int. Cl.[7] ..... H01R 9/09
(52) U.S. Cl. ..... 439/71
(58) Field of Search ..... 439/68, 71, 72, 439/271, 73, 74, 526, 630, 571, 66; 361/700

(56) References Cited

U.S. PATENT DOCUMENTS 3,205,408 A * 9/1965 Boehm et al. ..... 324/754
4,523,796 A * 6/1985 Rank ..... 439/65
5,288,238 A * 2/1994 Ikenaka et al. ..... 361/760
5,691,041 A 11/1997 Frankeny et al. ..... 428/209
5,699,228 A * 12/1997 Lee ..... 257/707
5,703,753 A * 12/1997 Mok ..... 174/16.3
6,132,220 A 10/2000 McHugh et al. ..... 439/66
6,358,063 B1 * 3/2002 Neidich ..... 439/271

* cited by examiner

*Primary Examiner*—Tulsidas Patel
*Assistant Examiner*—Phuong Dinh
(74) *Attorney, Agent, or Firm*—Robert W. Lahtinen

(57) ABSTRACT

Land grid array (LGA) connectors are used to attach circuit modules to printed circuit boards that present an array of noble metal or semi-noble metal plated contacts to not only effect a reliable connection, but also enable circuit module release and replacement. During replacement, the connector is discarded and a replacement circuit module is used. Only the contact array on the printed circuit board is reused. An in situ gasket carried by the connector is compressed against the circuit board in the assembled condition to form a sealed enclosure about the contact array at the printed circuit board surface which excludes particulate and gaseous contaminants. Thus when the module is replaced, the contact array site on the printed circuit board does not require cleaning or processing to overcome degradation of the contact materials or surfaces. Beyond providing a sealed enclosure, the gasket material should be selected for sealing, but inelastic qualities so that the uniform pressure applied to the contacts of the array is not impaired nor the total required contact force increased.

12 Claims, 4 Drawing Sheets

LGA CONNECTOR WITH INTEGRATED GASKET

FIELD OF THE INVENTION

The invention relates generally to electrical connectors and more particularly to land grid array (LGA) connectors.

BACKGROUND OF THE INVENTION

Current and future high performance computer systems and server systems rely on both large scale packaging of multiple high density interconnect modules and boards that must be upgraded in service. Many of these interconnect applications are beyond the scope of reliability using traditional solder interconnection technology as combined temperature gradients, packaging LW size and packaging mass prompt conditions for premature thermomechanical solder failure outside the scope of contact reliability requirements needed for system performance, and do not support the ability to provide field replacement of individual module elements. Thus, land grid array (LGA) connectors that provide removable and repluggable socketing capability of modules and boards are the required interconnect methodology.

LGA connectors that are used to electrically connect printed circuit boards to modules or other circuit boards provide high density, high performance interconnections that provide field upgrade and replacement capabilities. However, interfaces created between connector contacts and board surfaces are subject to potential reliability degradation from the entrance of corrosive environmental gases and particulate debris into the LGA contact areas. Of particular concern is the reliability of LGA interconnects that must be recreated because of the necessity to provide an in-service field upgrade or module replacement. As mating or separation and remating of LGA contact interfaces prompts significant potential for intermittent interconnection conditions to be created from both the presence of corrosion products or particulate debris on board and module surfaces which can create insulating layers or contact standoff conditions that inhibit reliable electrical contact formation.

SUMMARY OF THE INVENTION

To inhibit or eliminate significant potential for both corrosive gas ingress and particulate cross contamination within a land grid array (LGA) site designated for a system upgrade or required in-service module replacement, LGA connectors can be designed with in situ gaskets which seal the perimeter of the LGA contact areas of the connector to provide a barrier against particulate cross contamination and corrosive gas ingress. The gasket attaches to the frame or external walls of the LGA connector via insertion into a molded channel created within the connector frame or housing or can be affixed to the LGA frame or external connector housing using pressure sensitive adhesive films. The gasket provides interference atop card and/or module surfaces, but is sufficiently compliant such that loading of individual contacts to intended normal forces or to LGA connector frames, housings or incorporated contact standoffs is not impacted after connector actuation. These peripheral gaskets are compatible additions to frames or housings on a variety of LGA connector types including LGA connectors possessing metallic C-spring or D-spring contact members, LGA connectors comprised of wire "fuzz button" contacts, or LGA connectors possessing individual contact members comprised of metal filled polymeric elastomers.

The invention provides for significant reduction of cross contaminations by particulates and corrosive gases within an LGA connector system itself, thereby eliminating or reducing the need for secondary fixturing within the system packaging configuration, or by providing contamination reduction potential in systems where the addition of secondary fixturing to address contamination is not possible due to multiple design constraints. Moreover the use of secondary fixturing, such as gaskets or shields, on bulk printed circuit board assemblies or modules for contamination reduction creates problems when rework of individual board or module elements is required after card assembly and test, since the bulk of gasket materials are not compatible with elevated temperature operations or liquid exposure operations required for soldering and solder rework, heat sink removal operations, post solder wash, card bake, and adhesive cure operations.

Thus, removal of secondary gaskets is required prior to rework. Unfortunately, secondary gasket removal prompts a potential for organic cross contamination onto LGA pad contacts present on boards or modules as secondary gaskets are commonly affixed with adhesives that also must be removed prior to other rework operations. By providing the gasket on a disposable element, rework operations are vastly simplified and added cleanliness control for rework operations during assembly of boards and modules is also realized. In addition, by providing a gasket element on the connector itself, contamination control is also obtained in designs where room for additional shielding in secondary format is not practical.

Currently a typical LGA presents a matrix of 750 to 5000 contacts with the upper limit expected to be extended to 7500 in the near future. Since each contact in an array requires a contact force of 1 ½ to 4 ounces to assure that adequate electrical contact and operational reliability are achieved, the total clamping force for a 1000 LGA matrix of contacts would be from 90 to 250 pounds. The in situ gasket must have characteristics that not only seal the printed circuit board/connector interface against contamination, but must also not interfere with the even distribution of force across the matrix of contacts. The gasket material must preferably deform and seal without elasticity that would produce localized forces that disturb the equality of force applied to each contact. Preferably, the gasket material is secured to the LGA connector and deforms inelastically so that a seal is formed without introducing a restorative force that would increase the total clamping force required to achieve the minimum adequate force at each contact interface. The seal could also be effected by a deadsoft, malleable metal which possess no elasticity or memory that would tend to restore the metal to or approach an original configuration.

DETAILED DESCRIPTION

Figure 1:
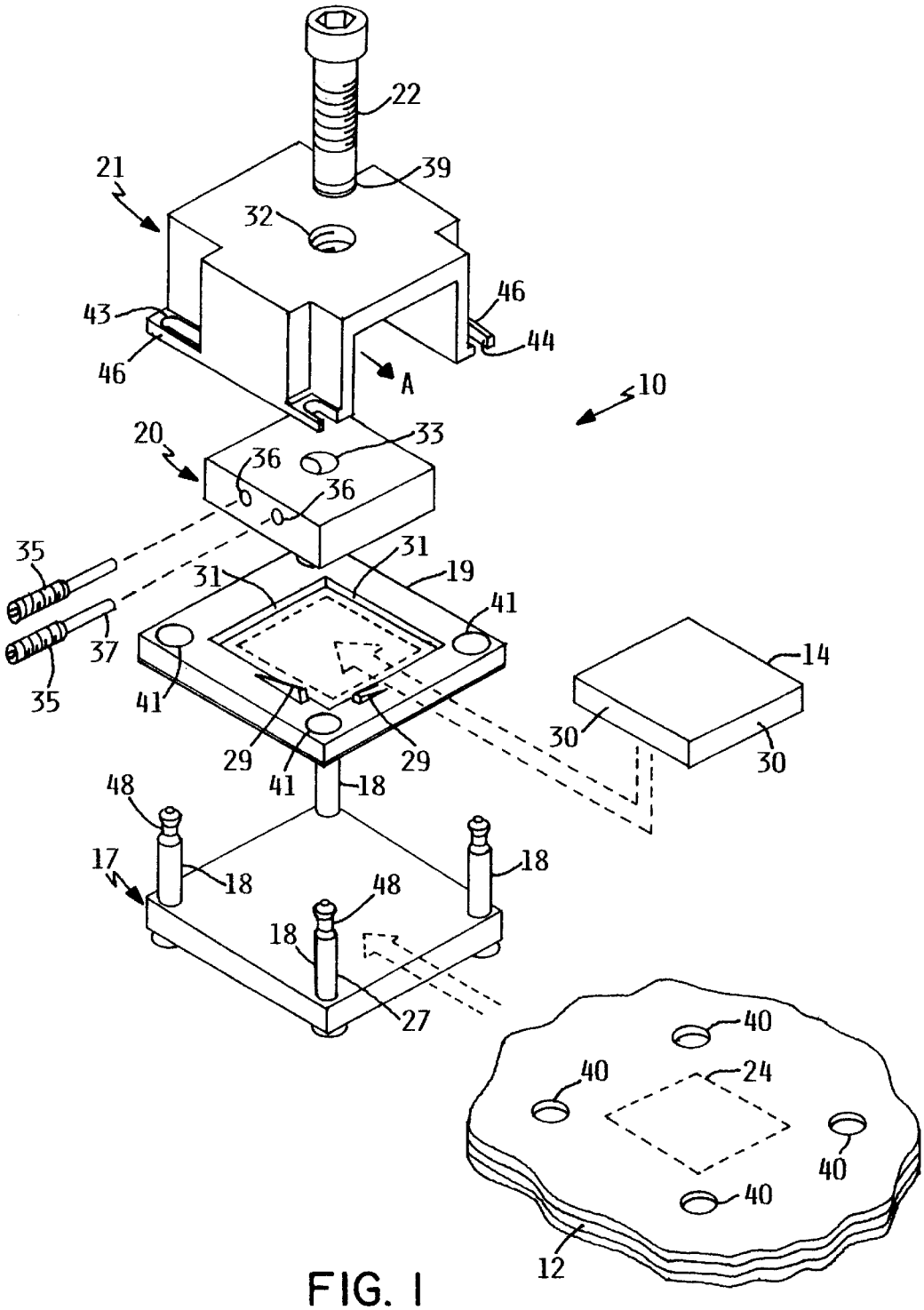
FIG. 1 is an exploded view of a land grid array (LGA) connector socket, circuit module, connector, and printed circuit board incorporating the present invention.

Referring to the drawings, FIG. 1 is an exploded view of a land grid array (LGA) connector assembly or socket 10 and the printed circuit board 12 to which it attaches a circuit module 14. The socket 10 includes a rigid and planar stiffener 17 with alignment pins 18, connector 19, rigid cap 20, arch 21, and screw 22. As shown, a circuit module 14 and connector 19 are situated between cap 20 and printed circuit board 12. Connector 19 has a frame portion that includes an opening in which circuit module 14 is received. The opening is bounded on two intersecting sides by walls 31 which are abutted by circuit module side walls to align the module with respect to the connector. Stiffener 1 7 and cap 20 ensure that the electrically connecting elements, the land grid array contacts 24 on printed circuit board 12 and the corresponding land grid array contacts on the connector 19, and on circuit on module 14 remain coplanar during compressive connection.

Stiffener 17 in FIG. 1 utilizes alignment pins 18 to ensure that the printed circuit board 12 and connector 19 are aligned within tight tolerances required by the high density of contacts within the arrays. The contact arrays are typically on 1 mm centers with the number of contacts within an array being from about 750 to about 5000 with the upper end of the range expected to soon be expanded to or greater than 7500. Alignment pin 27 has a smaller diameter than the other three to require that the stiffener 17, connector 19, arch 21, and printed circuit board 12 maintain a predetermined orientation in the assembled condition. The circuit module 14 is positioned by connector 19 which, in the assembled condition, has tapered, cantilevered and slightly inwardly projecting tabs 29 engaging the module side surfaces 30 and bias module 14 against the connector opening surfaces 31 to align the contact arrays of connector 19 and circuit module 14.

The arch 21 has a loading screw 22 which is received in a threaded opening 32 with the terminal end extending into an aperture 33 in rigid cap 20. A pair of screws 35 are received in rigid cap threaded openings 36 and have cylindrical terminal end portions 37 which engage the loading screw annular groove 39 to cause the groove and the rigid cap 20 to move in unison toward and away from the printed circuit board 12 as the loading screw 22 is rotated when the socket 10 is assembled to the circuit board.

When the stiffener 17 is mounted below printed circuit board 12 with the alignment pins 18 extending through board apertures 40 and connector apertures 41, the arch 21 is assembled by placing the enlarged ends of elongated apertures 43 (one of which is visible) over one pair of alignment pins 18 and the open ends of the open ended slots 44 adjacent the other pair of alignment pins 18 and sliding the arch in the direction of arrow A to capture the generally planar corner portions 46 in the grooves 48 of alignment pins 18.

The force applied to cap 20 by rotating screw 22 is directed at the center of cap by engagement of the groove 39 with the cylindrical terminal end portions 37 of screws 35 when screws are assembled in the threaded openings 36 of cap 20. Thereby, cap 20 pivots freely about the end of screw 22 to allow alignment of the underlying elements for an even distribution of the compressive force when the underlying elements are not perfectly planar. As cap 20 is advanced by rotating screw 22, circuit module 14, connector 19, and printed circuit board 12 are clamped between cap 20 and stiffener 17 to effect electrical contact between confronting contact arrays.

Figure 2:
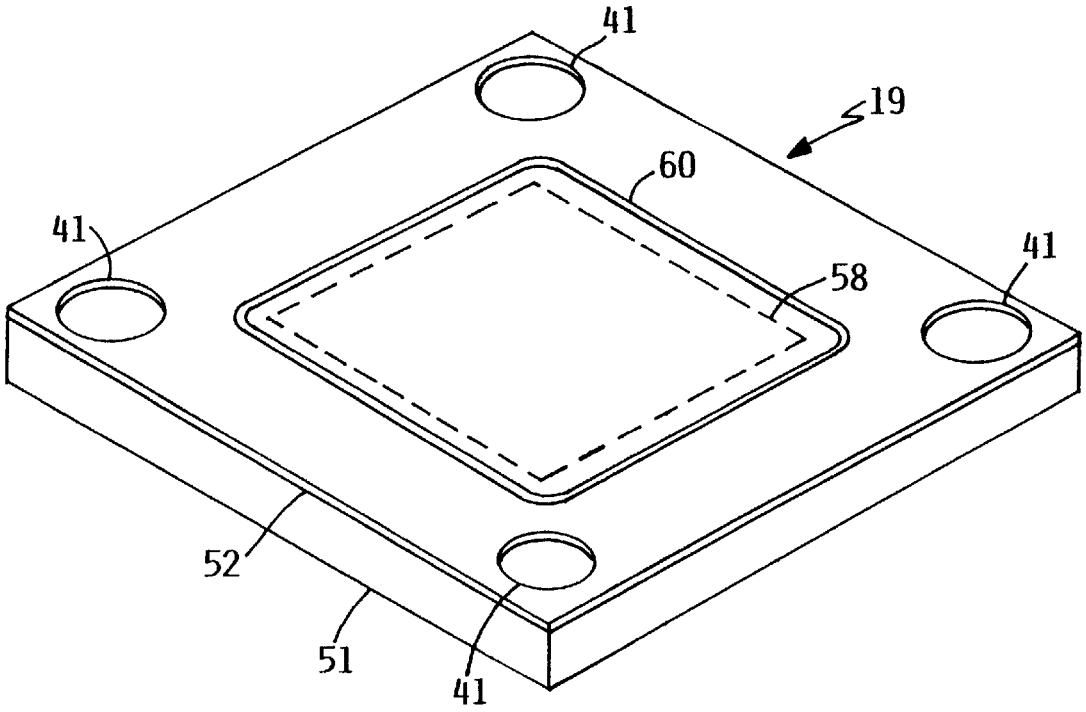
FIG.2 is an isometric view of the lower surface of the connector module of FIG. 1 showing the LGA contacts and perimeter gasket.
Figure 3:
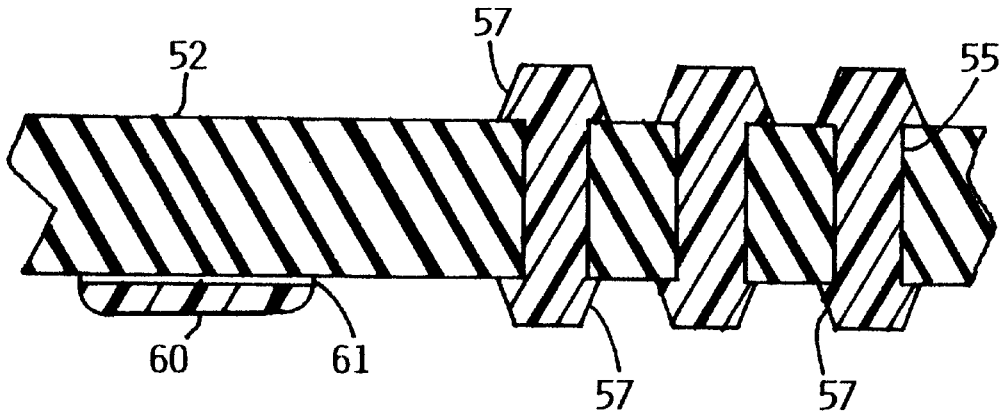
FIG. 3 is an inverted, partial section of the connector of FIG. 2 taken along line B—B.

FIG. 2 shows the lower surface of connector 19 which is obscured in FIG. 1. Connector 19 comprises a frame 51 on which is attached a layer of flex material 52 which supports a contact array 58. The layer of flex material 52, which provides the housing for the contacts of the array, must be dimensionally stable to enable contacts with a center to center pitch of no more than 1 millimeter in, for example, a forty by forty contact matrix, to be aligned with a similar matrix of contacts on a circuit module and also with the matrix of contacts presented by the circuit board to which the module must be electrically connected. Details of one form of the contact array are shown in the partial section view of FIG. 3. A matrix of cylindrical passages 55 serve as vias between the opposite major surfaces and are filled with electrically conductive material and include a raised contact 57 at each terminal end extending from the respective surface. In this example, the conductive material that fills the vias and forms the raised contacts can be an elastomer that is filled with silver particles to provide electrical conductivity.

In other LGA applications, many variations may occur. It is common to use multiple contact housings, such as quad housings, bonded to a single frame. The housings may be formed of flex material, such as described in the above example; semirigid or resilient material, or a solid material. The housing and frame may also be formed of solid material as a single integral part, which would form the housing 52 and frame 51 of the example of FIGS. 2 and 3 as a single element. The connector contacts may take forms other than the illustrated conductive elastomer. Traditional C-spring or D-spring contact members could be used or in high density applications using housing vias, "fuzz button" contacts could be the material of choice. The "fuzz button" contact is formed as a conductive mass of a single filament off conductive material, positioned in an LGA housing cylindrical via opening to present a projecting contact surface at each LGA housing surface. The single filament conductive mass is sufficiently compressed to establish massive numbers of intramass filament contacts and create numerous conductive paths between the contact surfaces.

Surrounding the connector contact array 58 and overlying the recess or opening in frame 51 is a continuous strip of gasket material 60 which is adhered to the flex material surface by a film of adhesive 6 1. In the assembled condition of the LGA connector assembly 10, the gasket is captured between the connector 19 and the printed circuit board 12 and forms a sealed enclosure about the interface of the printed circuit board LGA of contacts and the confronting contact array of the connector. The gasket may be formed from a variety of materials including butyl, urethane, or silicone rubber materials; filter materials; porous, closed cell foams, including neoprene; or even a very soft malleable metal. It is desirable that the gasket be deformable to create a seal and devoid of elastic properties that could destabalize the uniformity of contact interface pressures.

Compressive force is applied through cap 20 directly onto the LGA module 14 during the mounting process. Cap 20 is preferably composed of a high specific heat thermally conductive material. Since cap 20 is in direct contact with the LGA module it serves as a heat sink and where appropriate may include an extended surface to provide cooling fins.

Figure 4:
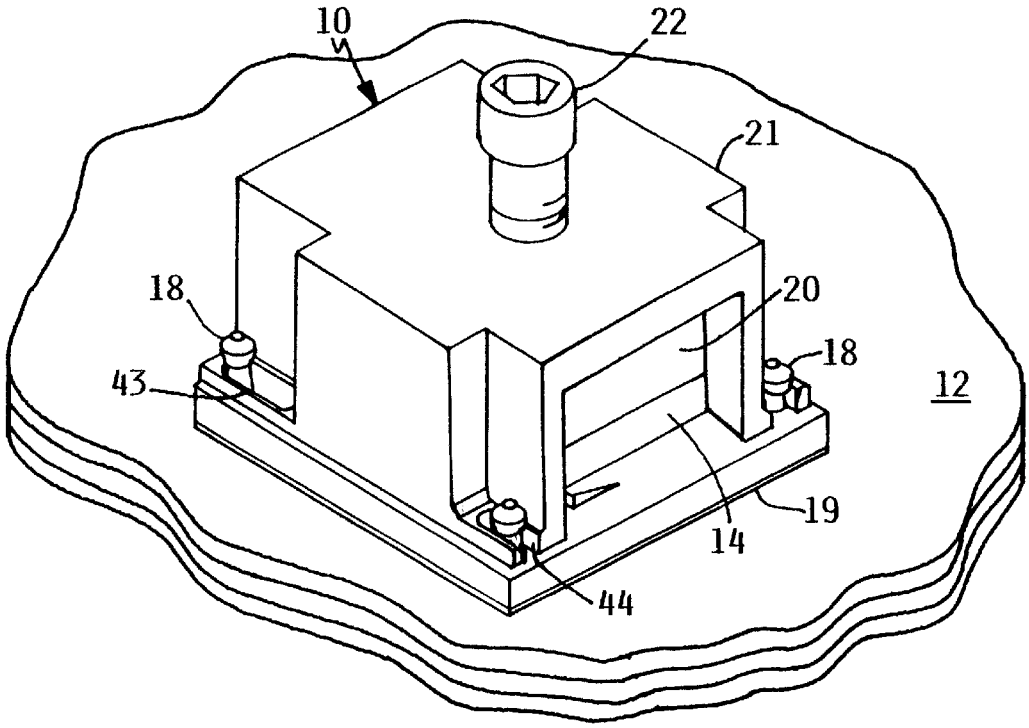
FIG. 4 is an assembled view of the LGA connector apparatus shown in FIG. 1.

FIG. 4 illustrates the socket 10 as it would appear when connected to printed circuit board 12 with the alignment pins 18 captured in the slots 43, 44 of arch 21 and the screw 22 torqued as required to achieve the correct engagement forces between both the contact interfaces of the circuit module and connector and the connector and the printed circuit board while compressing the in situ gasket surrounding the contact array to isolate the engaged contact arrays at the printed circuit board surface within a sealed enclosure. Thus, when it is necessary to replace or exchange the circuit module, the LGA connector assembly can be removed and a replacement or upgraded circuit module installed with minimal or no preparation of the LGA site on the printed circuit board. The sealed enclosure effected by the in situ gasket significantly reduces debris removal requirements and the restoration of conditions at the site to overcome impairment caused by exposure to contaminated ambient conditions over time.

During rework, the connector 19 is a disposable element. A replacement connector and the replacement circuit module can arrive at the site in sealed, contaminant free packaging which, with careful handling and assembly, assures an unimpaired replacement. Only the printed circuit board LGA contacts must be reused and the enclosure provided by the in situ gasket mounted on the connector assures that optimum conditions of contamination free cleanliness and uncompromised contact surface conditions are maintained. The site sealed by the housing gasket is contaminant free and prepared to be reconnected to a replacement or upgraded module with a corresponding LGA contact site. However, care must be taken that the surfaces about the sealed contact site are cleared of debris and contaminants prior to breaking the seal of the gasket so that the LGA site is not contaminated during module replacement.

While the invention has been shown and described with reference to preferred embodiments thereof, it will be understood that various changes in form and details may be made therein without departing from the spirit and scope of the invention.

What is claimed is:

1. A land grid array connector assembly comprising a printed circuit board including a first array of contacts presented at the surface thereof;

a circuit module including a second array of contacts;

a generally planar connector having a multiplicity of vias extending therethrough and presenting at each surface a compressible, projecting contact to form a third array of contacts at one connector surface adapted to be aligned with said printed circuit board first array of contacts which are respectively connected through said vias to a fourth array of contacts at the connector surface opposite said one connector surface adapted to be aligned with said circuit module second array of contacts;

gasket means supported on and adhered to said one connector surface surrounding said third array of contacts as an integral portion of said connector and disposed between said circuit module and said printed circuit board in the assembled condition of said land grid array connector assembly electrically connecting said first array of contacts respectively to said second array of contacts;

aligning means for positioning said first array of contacts respectively in alignment with said third array of contacts and said second array of contacts respectively in alignment with said fourth array of contacts; and clamping means for urging said circuit module toward said printed circuit board to compressively retain said aligned contact arrays and said connector therebetween, whereby said first array of contacts is respectively electrically connected to said second array of contacts and said gasket means forms a contamination excluding enclosure about said first and third arrays of contacts.

2. The land grid array connector assembly of claim 1 wherein the gasket means comprises a layer of sealing material adhered to said one surface of said connector by a film of adhesive.

3. The land grid array connector assembly of claim 2 wherein said sealing material is an inelastic material.

4. The land grid array connector assembly of claim 2 wherein said connector comprises a substantially rigid frame with an opening therethrough and a layer of dimensionally stable flex material attached to said frame and spanning said opening with said vias and said fourth array of contacts being formed in the portion of said flex material spanning said opening.

5. The land grid array connector assembly of claim 4 wherein said aligning means comprises first alignment means which includes intersecting connector frame wall portions which partially define said opening and biasing means for urging a circuit module positioned in said opening into abutment with said intersecting wall portions.

6. The land grid array connector assembly of claim 5 wherein said aligning means further comprises second aligning means having a portion formed as a part of said connector frame for positioning said frame with respect to said printed circuit board to effect alignment of said first array of contacts with said connector third array of contacts.

7. A land grid array connector for connecting a contact array disposed at the surface of a board with an aligned contact array presented by a circuit module to be secured to and electrically connected to said board when said circuit module is clamped against said board with the connector aligned therebetween comprising a generally planar connector member having a multiplicity of vias extending therethrough with conductive material therein and presenting a projecting, compressive contact at each via end to form a first contact array at one surface of said member that is configured to enable alignment with said board contact array and a second contact array at the member surface opposite said one surface that is configured to enable alignment with said circuit module contact array, and gasket means secured to said one surface as an integral part of said generally planar connector member in surrounding relation to said first contact array and positioned to be between said connector member and said board to form a sealed, contamination excluding enclosure about the board contact array and the planar connector member first contact array when said circuit module is clamped against said board with said gasket means therebetween.

8. The land grid array connector of claim 7 wherein said gasket is formed of inelastic material that forms a seal without increasing that clamping. force necessary to assure effective electrical connection between the contact arrays.

9. The land grid array connector of claim 7 wherein said gasket means is formed of a soft, inelastic material.

10. The land grid array connector of claim 9 wherein said generally planar connector comprises a substantially rigid frame with an opening therethrough and a layer of dimensionally stable flex material attached to said frame and spanning said opening with said vias and said second contact array being formed in the portion of said flex material spanning said opening.

11. The land grid array connector of claim 10 further comprising alignment means which includes intersecting connector frame wall portions which partially define said opening and biasing means for urging a circuit module positioned in said opening into abutment with said intersecting wall portions.

12. The land grid array connector of claim 11 wherein said gasket means is secured to said layer of flex material by a film of adhesive.

* * * * *